US005147059A

United States Patent [19]

Olsen et al.

[11] Patent Number: 5,147,059

[45] Date of Patent: Sep. 15, 1992

[54] SEAL WITH AUTOMATIC RELEASE

[75] Inventors: Eskil H. Olsen; Stig Lillelund, both of Gentofte, Denmark; Robert H. C. M. Daenen, Erembodegen, Belgium

[73] Assignee: Dart Industries Inc., Deerfield, Ill.

[21] Appl. No.: 754,863

[22] Filed: Sep. 4, 1991

[51] Int. Cl.[5] ..... B65D 43/04

[52] U.S. Cl. ..... 220/281; 220/306; 220/366; 215/301

[58] Field of Search ..... 220/281, 306, 366; 215/301

[56] References Cited

U.S. PATENT DOCUMENTS

| | | | |
|---|---|---|---|
| 3,484,016 | 12/1969 | Turner | 220/281 |
| 3,559,843 | 2/1971 | Kern . | |
| 3,679,089 | 7/1972 | Swett et al. . | |
| 3,782,575 | 1/1974 | Braun . | |
| 3,837,535 | 9/1974 | Gerk | 222/143 |
| 3,860,137 | 1/1975 | Wilson . | |
| 4,187,953 | 2/1980 | Turner | 215/301 |
| 4,234,100 | 11/1980 | Chabot | 220/306 |
| 4,500,006 | 2/1985 | Lafortune et al. | 215/224 |
| 4,535,905 | 8/1985 | Sandhaus | 215/218 |
| 4,760,936 | 8/1988 | Mueller . | |
| 4,991,732 | 2/1991 | La Barge et al. . | |

*Primary Examiner*—Stephen Marcus
*Assistant Examiner*—Nova Stucker
*Attorney, Agent, or Firm*—John A. Doninger

[57] ABSTRACT

A seal for a container having an outwardly directed annular rim. The seal includes a top panel with a central section and an annular lever section integrally joined to the central section by a living hinge. A side wall integrally depends from the outer periphery of the lever section and includes an inwardly directed concavity for receiving the rim edge. A continuous convexity below the concavity provides for a snap-mounting of the seal to the container rim and a vertical skirt below the convexity provides for a guide for mounting the seal. A fulcrum rib depends from the undersurface of the lever section and engages the container rim on a depression of the top panel at the hinge to swing the side wall away from the rim. Vent openings are provided through both the fulcrum rib and the convexity to maintain pressure release air flow as the seal is mounted and removed.

19 Claims, 3 Drawing Sheets

SEAL WITH AUTOMATIC RELEASE

BACKGROUND OF THE INVENTION

The invention is broadly concerned with seals for containers of the type normally utilized in a kitchen environment for the storage of foodstuffs.

The seals of particular concern are adapted to snaplock to the rims of plastic food containers with the containers and seals themselves formed of an appropriate synthetic resinous material, for example polypropylene.

A principal goal of such seals is to hermetically close or seal the container while at the same time provide convenient access to the container contents. As such, the seal or lid, at its most practical, must easily mount to the container, completely seal the container when mounted, and be easily and conveniently removed from the container.

However, when providing an airtight closure, pressure differentials that develop between the interior and the exterior of the container during the mounting of the container tend to disrupt the effectiveness of the seal and the ease of applying the closure. Similarly, a release of the seal can also be inhibited by the pressure differential, particularly when a lower pressure exists within the container. Attempts have been made to alleviate the various pressure differential problems by the provision of venting systems.

A further problem arising from sealed plastic lids which closely conform to the container rim peripherally thereabout, is how to easily remove the lid, particularly in those situations wherein neither the container nor the lid provide a convenient grasping means. Conventionally, the lid is peeled upward about the periphery of the container rim, requiring the use of two hands and possibly an awkward tipping of the container.

Various proposals have been put forth for a pivoting or rocking release of the seal. However, little has been developed in the way of practical systems for providing, in a single seal, a cooperative combination of features which result in a seal combining superior sealing capability with practical and efficient means to both mount and remove the seal.

SUMMARY OF THE INVENTION

In achieving a superior seal, the present invention proposes a seal which provides for a continuous venting of the interior of the container as the seal is applied and until such time as the seal, with an audible snap, hermetically seals to the container rim, thereby avoiding any tendency for generating excess internal pressure as the seal is applied and as might disrupt the positive seating of the seal.

The seal of the invention also proposes the incorporation therein of integral lever sections which, through integral fulcrum means, allows for a release of the seal by manipulation of the seal with a single hand and without disruption of the bowl, notwithstanding the positive hermetic sealing of the container achieved by the fully mounted seal. The effective removal of the seal as described, is substantially enhanced by a venting system which accommodates any pressure differential between the interior and exterior of the container such as might tend to restrict or momentarily interfere with the smooth removal of the seal.

In order to achieve the enhanced benefits and advantages sought by the invention, the seal includes a circular top panel with a depending side wall peripherally thereabout. The top panel comprises a central section and a relatively narrower lever section peripherally about the central section and integrally joined thereto by a living hinge. The side wall in turn is integrally joined to the outer periphery of the lever section.

The side wall has an inwardly directed concavity or annular groove peripheral thereabout and configured to intimately seal, in an air excluding manner, to the outer rim edge of an associated container. An inwardly directed continuous bead or convexity is provided immediately below the concavity. The bead or convexity, above the crown thereof, includes an arcuate surface merging into the concavity. The surface of the convexity immediately below the crown thereof is substantially planar with peripherally spaced vertically elongate tapered projections which engage the container rim as the seal is press fit to the rim, the projections precluding full contact of the rim with the convexity to allow for a venting of the container until the container rim engages and moves upwardly beyond the crown of the convexity and into the sealing groove or concavity immediately thereabove.

The side wall of the seal includes a depending skirt portion below the convexity which enables a loose retention of the seal on the container either as an unsecured temporary closure therefor or as an alignment or stabilizing means facilitating a snap locking of the seal to the container.

The seal will be secured to the container rim by a downward pressing on and around the outer portion of the top panel, the seating of the seal being audibly signalled by a slight snapping sound.

The release of the seal is effected as an automatic response to the depression of the central section of the top panel radially inward of the lever section. In order to effect this, the lever section includes an annular depending fulcrum rib integral therewith and in radially outwardly spaced relation to the hinged joinder between the lever section and the central section. The fulcrum rib, with the seal mounted to a container rim, has the lower edge thereof spaced slightly above the rim and inward of the outer sealing edge thereof. As the central section of the top panel is depressed, the outer lever section will shift downwardly engaging the fulcrum rib with the container rim and corresponding upwardly pivoting the side wall as the lever section rocks about the engaged rib and pivots at the hinged joinder with the central section. It will of course be appreciated that the lever section is of sufficient rigidity to effect the desired pivotal movement.

As the central section is moved inwardly relative to the container, air will be forced from the container, normally developing a reduced pressure within the container which tends to resist free movement of the seal from the container. The resistance to removal, while not substantial, will be noticeable, particularly when the container or bowl does not completely release from the seal as the seal is raised, resulting in an elevating and a dropping of the bowl. This problem is avoided in the present invention by the specific provision of transverse vents through the peripherally continuous fulcrum rib whereby pressure imbalance as might affect removal of the seal will not occur.

While the vent means associated with the annular bead below the sealing groove provides a pressure release which enhances the mounting of the seal, this venting means also cooperates with the venting means defined through the fulcrum rib in that, upon a pivoting of the lever section, the outer side wall is elevated upward and outward relative to the container rim sufficient to move the convexity protuberances or projections to the outer rim edge of the container whereby the outer vents, defined in the side wall by the projections, cooperate with the inner vents through the fulcrum ribs to achieve complete pressure release.

Other details and advantages of the invention will become apparent from the more complete description following hereinafter.

DESCRIPTION OF PREFERRED EMBODIMENT

Referring now more specifically to the drawings, the seal or closure 10 of the invention is specifically adapted to mount and hermetically seal to foodstuff containers, for example mixing bowls, collection bowls or like containers found in a kitchen environment. Such bowls, as illustrated at 12, in order to receive the seal 10 include an outwardly and upwardly flaring bowl rim 14 having a continuous convex outer rim edge or lip 16.

Figure 1:
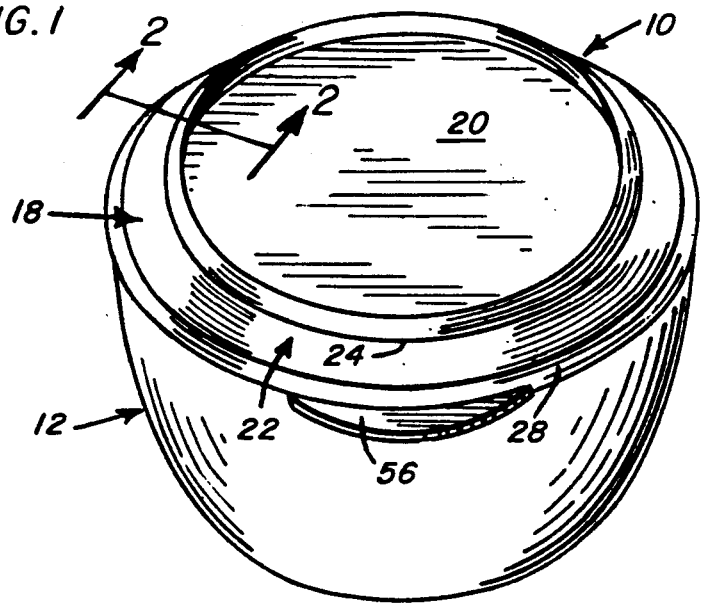
FIG. 1 is a perspective view of a bowl with he automatic release seal mounted thereto
Figure 2:
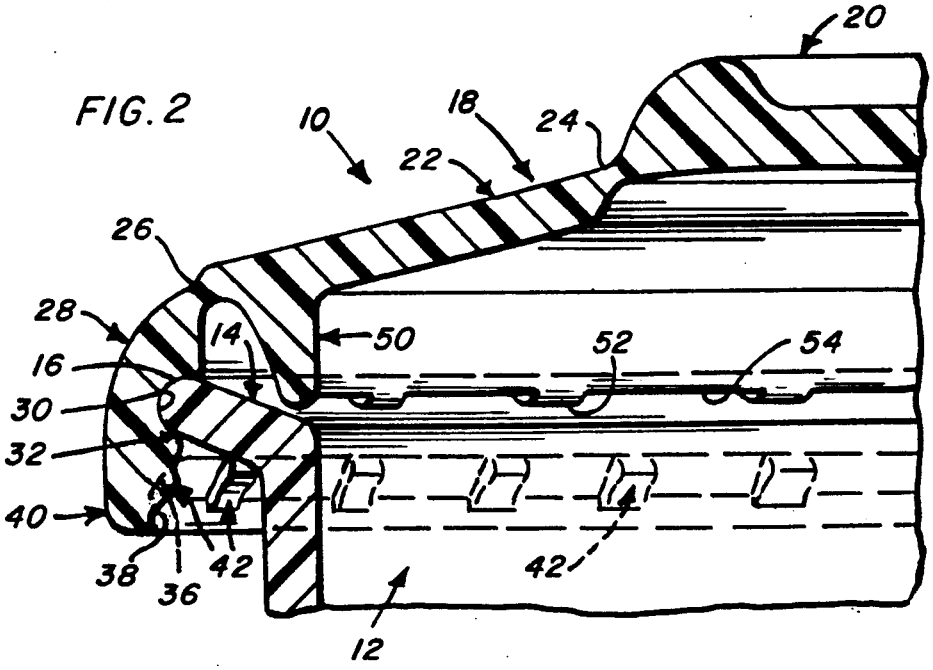
FIG. 2 is an enlarged cross-sectional detail taken substantially on a plane passing along line 2—2 in FIG. 1.
Figure 3:
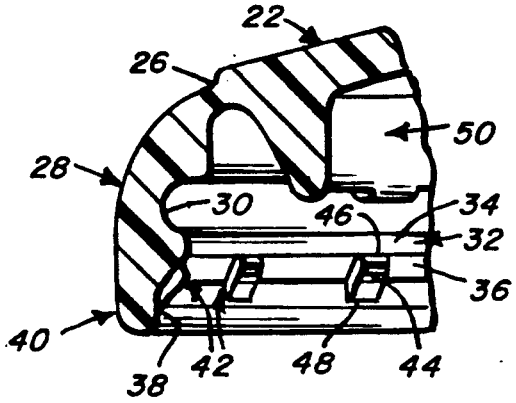
FIG. 3 is a cross-sectional detail through an edge of the seal slightly rotated from the cross-sectional view of FIG. 2.
Figure 4:
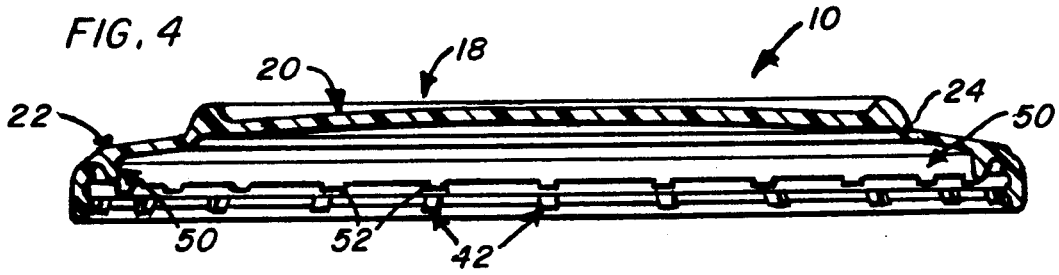
FIG. 4 is a transverse cross-sectional view, on a reduced scale, through the seal itself.

The seal 10 includes a top panel 18 defining a circular central section 20 and an annular lever section 22 integrally joined to the outer periphery of the central section 20 by a living hinge 24 formed by a relatively thinner hinge joinder section as seen in the enlarged detail of FIG. 2.

The annular lever section 22 is at a slight downward and outward inclination from the annular hinge 24. The central section 20 is slightly elevated relative to the lever section and may be planar, upwardly stepped, or have a low dome-like configuration.

The lever section 22 terminates in an outer edge 26 with a annular imperforate side wall 28 integrally formed therewith and depending therefrom. The joinder between the lever section 22 and side wall 28 at the lever section edge 26 is relatively thinner than the thickness of the side wall or lever section, and, while not providing a relatively flexible hinge as at 24, does allow for a minor degree of flexure of the side wall 28 relative the lever section 22 to facilitate a mounting of the seal in particular.

The inner surface or face of the side wall 28 includes a concave groove or concavity 30 continuously about the side wall and of a size and so configured as to receive the outer rim edge 16 of an associated container or bowl 12 in a hermetically sealed manner therein This sealing relationship will extend completely about the periphery of the bowl rim.

An annular inwardly directed bead or convexity 32 is defined on the inner surface of the side wall 28 immediately below the concavity 30. The convexity, above the crown or crown portion 34 thereof, defines a smooth convex continuation of the concavity immediately thereabove for a guided movement of the rim edge thereto and therefrom.

The annular bead or convexity 32, below the crown 34, is defined by a substantially planar face 36 which inclines outwardly from the crown portion to the vertical inner face 38 of a skirt portion 40 depending below the convexity and defining the bottom extent of the side wall 28. The vertical face 38 of the skirt portion 40 is continuous about the side wall 28 and is in a vertical plane outwardly offset from the innermost extent of the concavity 30 to define a seal mouth area of a diametric size for reception of the rim portion of a container or bowl within the skirt freely and without sealing thereto, providing in effect a closure for the container and a means for freely retaining the seal on the container as a temporary closure or as a means for alignment of the seal for subsequent fully seated and sealed engagement.

The planar lower face 36 of the convexity 32 has a series of vent-defining projections or protuberances 42 at equally spaced points thereabout. Each protuberance 42 includes a crown 44 at approximately mid height relative to the planar surface 36 and tapers therefrom to merge respectively at the upper end into the crown portion 34 of the convexity 32, as at 46, and at the lower end 48 into the vertical inner face 38 of the skirt in spaced relation below the planar inclined surface 36 of the convexity 32. Thus formed, the protuberances 42 will engage the outer edge 16 of the container rim both as the seal freely sits on the container rim and as the seal moves inwardly thereon until such time as the container rim moves inwardly beyond the protuberance 42 and convexity 32 into nested sealed engagement with the concavity 30. The actual venting occurs through the elongate sections of the lower portion of the convexity 32 between the protuberances 42 with air flowing freely about the outer edge of the container rim between the points of engagement of the container rim with the protuberances.

The seal 10 is completed by the provision of a fulcrum rib 50 integral with the undersurface of the lever section annularly thereabout and radially outward from the hinge joinder 24. As noted in the drawings, the fulcrum rib 50 is positioned substantially closer to the outer annular edge portion 26 of the lever section than to the hinged joinder 24, providing in effect a long lever arm from the fulcrum rib 50 to the hinge joinder 24 for manipulation in a manner to be described subsequently.

The lower arcuate edge 52 of the fulcrum rib 50 is upwardly relieved at equally spaced arcuately elongate portions 54 therealong to define a series of spaced vents or vent openings particularly adapted for pressure release and free flow of air as the seal 10 is released for removal of the container 12.

Figure 7:
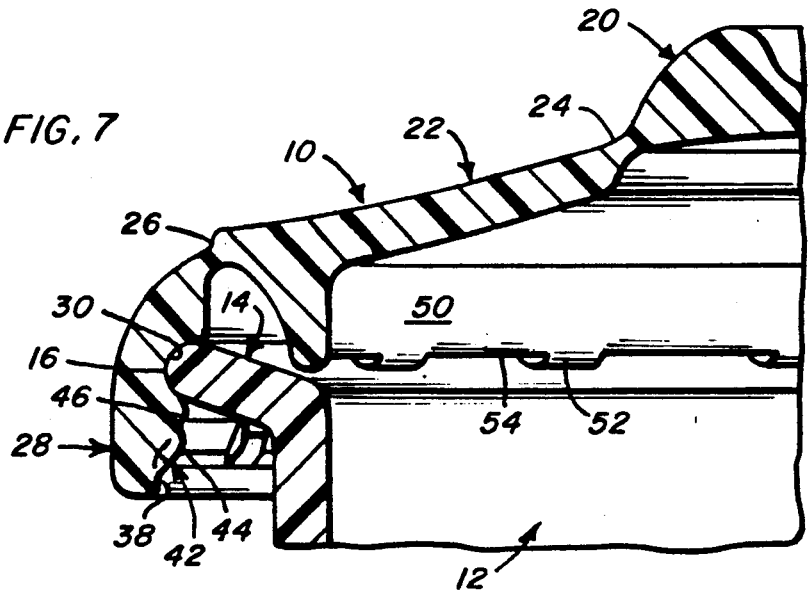
FIG. 7 illustrates the fully mounted seal following the sequence of FIGS. 5 and 6.

The fulcrum rib 50 so relates to the sealing concavity 30 and the rim 14 of the corresponding container or bowl 12 as to, as will be noted in FIGS. 2 and 7, have the lower edge 52 thereof closely adjacent but slightly upwardly spaced from the upper surface of the bowl rim 14 in the at rest and sealed position of the seal 10. In this manner, there is no possibility of engagement of the rib with the rim as might affect the proper seating of the seal and the hermetic sealing desired.

Figure 5:
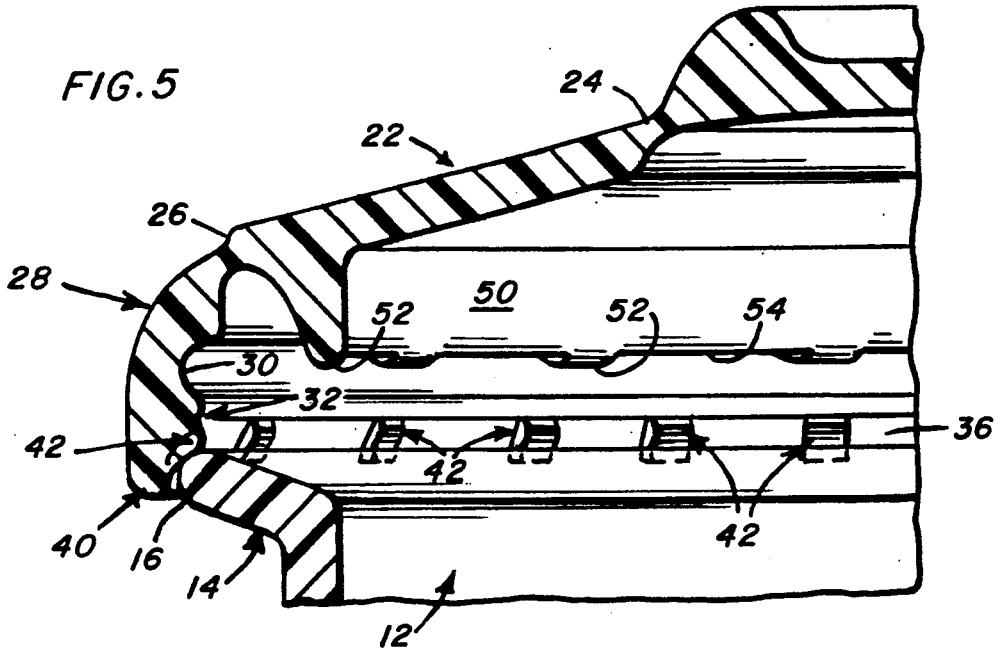
FIGS. 5 and 6 illustrate a sequence of mounting the seal to the bowl.
Figure 6:
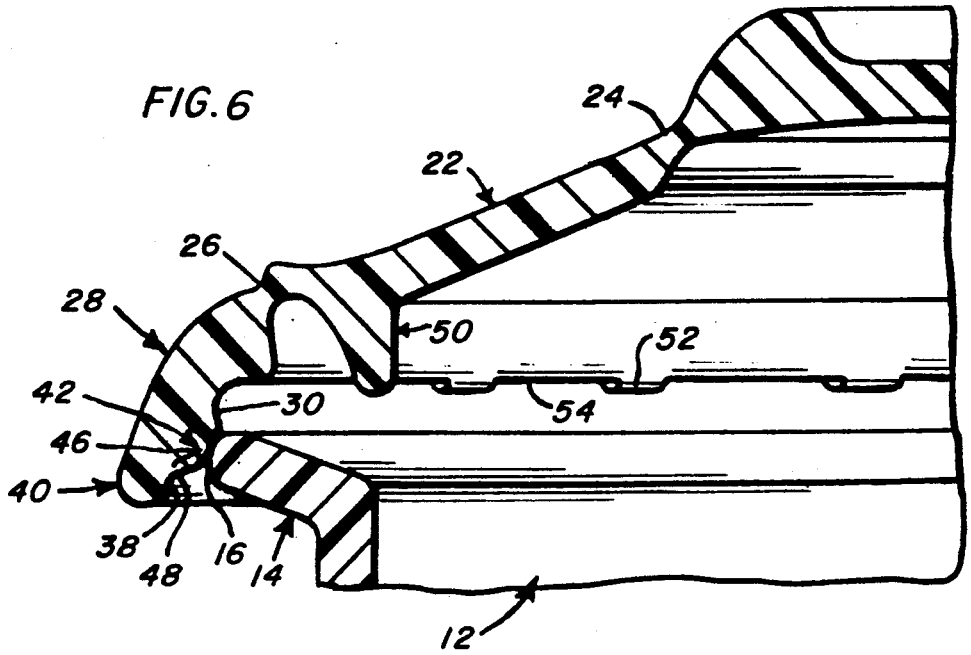

Noting the sequence of views at FIGS. 5-7, the lid is initially loosely placed on the container rim with the rim seated within the side wall skirt portion 40 and with the protuberances 42 engaging the rim to define vent passages. The seal, retained against accidental shifting by the peripheral skirt, can remain loosely in this position or, alternatively, the seal can be fully seated on the rim by exerting a downward pressure about the outer periphery of the top panel of the seal. The venting provided by the protuberances 42 will facilitate the seating of the seal by avoiding the build up of internal pressure as might tend to resist the proper seating of the seal. The final seating of the seal, noting FIGS. 6 and 7, with the rim edge 16 received within the seal concavity 30 will be effected with an audible snap as the rim edge moves upward beyond the annular bead or convexity 32. The slight outward flexure of the seal side wall 28 required to move downwardly over the bowl rim will be accommodated by the inherent flexibility of the seal, particularly at the slightly thinner joinder area at edge 26 at the upper edge of the side wall 28. When fully seated, and as previously noted, the lower edge 52 of the fulcrum is slightly upwardly spaced from the bowl rim.

Figure 8:
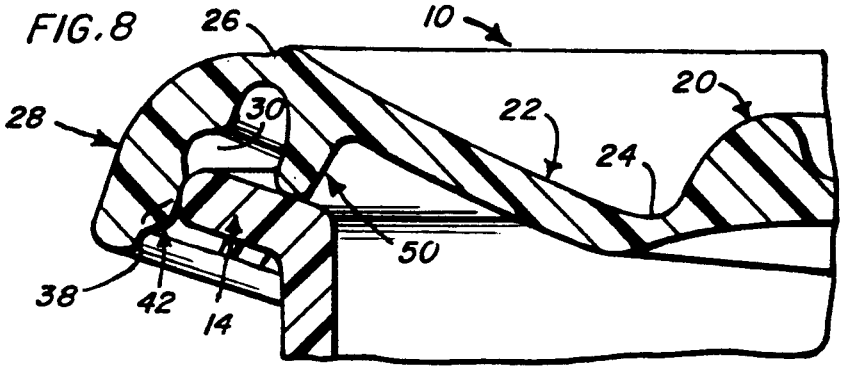
FIG. 8 illustrates a first step in the sequence of releasing the seal from the bowl.

In order to remove the seal, the seal is manipulated to provide in effect an automatic release upon depression of the central section 20, normally adjacent the hinged joinder 24. Noting FIGS. 8 and 9, upon an initial depressing of the central section, the lever section 22 moves downwardly to engage the lower edge of the fulcrum rib 50 with the bowl rim. Upon engagement with the bowl rim, the lever section 22 pivots thereabout with the side wall 28 of the seal swinging upwardly to disengage from the rim outer edge or lip 16. Both venting systems, initially the vents through the lower edge of the fulcrum rib 50 and subsequently the vents within the side wall, allow for a free transfer of pressure and flow of air whereby any tendency of the lid to "stick" or be retained to the rim by reduced pressure within the container is avoided. Were the vents to be omitted, low pressure within the container generated by a forcible expelling of air through the deformation of the central section of the seal would tend to either draw the seal back into sealed engagement with the rim upon release of manual pressure on the seal, or produce a slightly hesitancy before the bowl is released. This slight hesitancy, assuming the seal is lifted by the edge as the central section is depressed, could result in a "sticking" of the bowl to the seal and a subsequent dropping of the bowl.

The actual removal of the seal from the bowl will normally be effected by a grasping of the edge of the released seal by the fingers of the same hand which, through the thumb, depresses the central section. It is preferred that the side wall of the seal be provided with a projecting tab 56 beneath which the fingers of hand can engage as the thumb depresses the adjoining portion of the central section. In this manner, the seal, as it is released, can be lifted and easily removed by the one hand.

Figure 9:
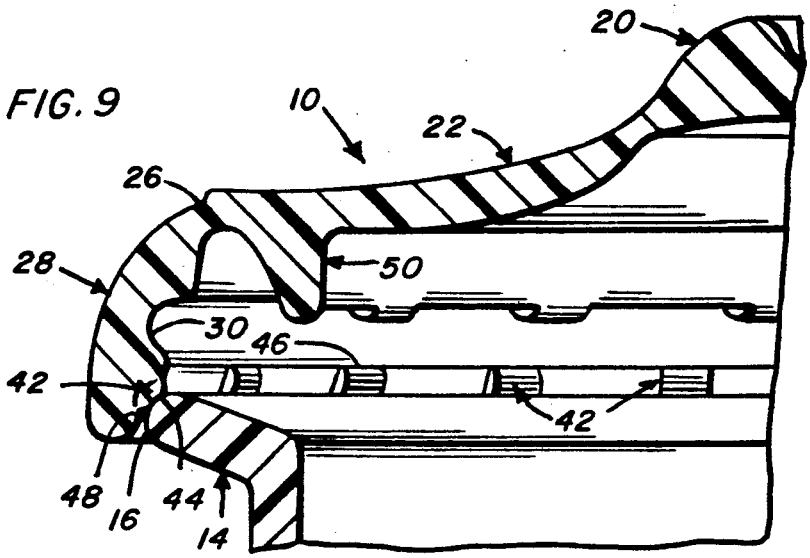
FIG. 9 illustrates the released seal resting on the bowl rim.

If the seal is to be moved from a sealed position to the unsealed position of FIG. 9, and not removed from the container, the dual vents and the positioning of the fulcrum rim 50 adjacent the side wall will, upon a depression of the central section, tend to provide sufficient upward movement of the side wall to move the bead 32 above the rim edge 16 even without a grasping and raising of the outer edge of the seal.

As will be appreciated, the seal, and in particular the lever section thereof, should be of sufficient rigidity to permit the lever effect, while at the same time incorporating a degree of flexibility to allow for engagement and disengagement of the seal side wall with the bowl rim. Similarly, for maximum efficiency in the automatic release of the seal, while at the same time providing for a positive seal without interference from the fulcrum rib, the fulcrum rib should, upon a mounting of the seal, be positioned as close to the rim of the bowl as possible without actually touching the rim of the bowl.

We claim:

1. A seal adapted to mount to an outwardly directed rim portion of a container, the rim portion having a peripheral lip; said seal comprising a top panel including a central section, a lever section peripherally about and extending outwardly from said central section thereabout and terminating in an outer edge portion, and hinge means integrally joining said lever section to said central section for pivotal movement of said lever section relative to said central section, an imperforate side wall integral with and depending from said outer edge portion of said lever section, fulcrum means integral with and depending from said lever section in spaced relation between said hinge means and said side wall and relatively closer to said side wall, said fulcrum means being selectively engageable with the container rim portion for fulcrum movement of said lever section and an upward and outward movement of said side wall upon a depression of said top panel adjacent said hinge means, said side wall having an inner surface, a concavity defined in said inner surface continuously along said side wall and downwardly spaced from said lever section for a hermetic sealed positioning of the rim lip therein upon downward movement of said seal on the container rim portion, said concavity being defined in part by a convexity on said inner surface coextensive with said concavity and immediately therebelow, first vent means for maintaining an air flow communication transversely across said fulcrum means when said fulcrum means is selectively engaged with the container rim portion for fulcrum movement of said lever section, and second vent means through said convexity for maintaining air flow a said seal is moved to position the container rim lip into said concavity.

2. The seal of claim 1 wherein said side wall includes a skirt portion below said convexity, said skirt portion having an inner face defined by said inner surface of said side wall, said skirt inner face being outwardly offset relative to said concavity and defining a seal mouth area of a diametric size adapted to freely receive the container rim portion therein for alignment of said seal on the container without a sealing of said seal to the container and as a guide for sealing said seal to the container.

3. The seal of claim 2 wherein said convexity includes upper and lower surface portions defining a central crown therebetween, said second vent means being defined along said lower surface portion and extending between said skirt inner face and said crown whereby a continuous venting is provided about the rim lip as the lip moves inward of said seal and until such time as the rim lip reaches and moves inwardly beyond said convexity crown.

4. The seal of claim 3 wherein said lower surface portion of said convexity is planar with protuberances projecting therefrom at spaced points about said seal, said second vent means being defined between adjacent protuberances.

5. The seal of claim 4 wherein said fulcrum means comprises a depending integral fulcrum rib of a length coextensive with said lever section, said fulcrum rib including a lower edge portion selectively engageable with the container rim, and a series of spaced recesses in said lower edge portion defining said first vent means.

6. The seal of claim 5 including an integral joinder between said side wall and said lever section having a degree of resilient flexibility substantially less than said hinge means for limited resilient outward movement of said side wall relative to said lever section to accommodate movement of said side wall over the container rim.

7. The seal of claim 1 wherein said convexity includes upper and lower surface portions defining a central crown therebetween, said second vent means being defined along said lower surface portion and extending to said crown whereby a continuous venting is provided about the rim lip as the lip moves inward of said seal and until such time as the rim lip reaches and moves inwardly beyond said convexity crown.

8. The seal of claim 7 wherein said lower surface portion of said convexity is planar with protuberances projecting therefrom at spaced points about said seal, said second vent means being defined between adjacent protuberances.

9. The seal of claim 1 wherein said fulcrum means comprises a depending integral fulcrum rib of a length coextensive with said lever section, said fulcrum rib including a lower edge portion selectively engageable with the container rim, and a series of spaced recesses in said lower edge portion defining said first vent means.

10. The seal of claim 9 wherein said side wall includes a skirt portion below said convexity, said skirt portion having an inner face defined by said inner surface of said side wall, said skirt inner face being outwardly offset relative to said concavity and defining a seal mouth area of a diametric size adapted to freely receive the container rim portion therein for alignment of said seal on the container without a sealing of said seal to the container and as a guide for sealing said seal to the container.

11. In combination, a container with a snap-on seal therefor; said container including a peripheral radially outwardly directed rim thereabout, said rim terminating in a continuous outer edge, said seal being mountable to said rim and comprising a top panel including a central section, an annular lever section peripherally about said central section and terminating in an outer edge portion, and hinge means integrally joining said lever section to said central section, a side wall integral with and depending from said outer edge portion of said lever section, fulcrum means integral with and depending from said lever section annularly thereabout and spaced between said hinged means and said side wall for selective engagement with said container rim, said side wall having an inwardly directed sealing area continuously thereabout, said seal, when mounted to said container, receiving said rim edge within said sealing area, said rim edge and said sealing area being configured to define a hermetic sealing therebetween, said fulcrum means being positioned in closely spaced relation above said container rim radially inward of said rim edge and selectively engageable with said rim upon a depression of said top panel adjacent said hinge means for a resultant upward swinging of said side wall and a release of said container rim edge from said sealing area, vent means defined transversely through said fulcrum means and maintaining air flow transversely through said fulcrum means upon engagement of said fulcrum means with said container rim, and second vent means defined on said side wall immediately below said sealing area for maintaining air flow about said rim edge as said seal is inwardly moved onto said container for a seating of said rim edge in said sealing area.

12. The seal and container combination of claim 11 including spaced protuberances projecting inwardly from said side wall at spaced points about said seal immediately below said sealing area, said second vent means being defined between adjacent protuberances.

13. In combination, a container with a snap-on seal therefor; said container including a peripheral radially outwardly directed rim thereabout, said rim terminating in a continuous outer edge, said seal being mountable to said rim and comprising a top panel including a central section, an annular lever section peripherally about said central section and terminating in an outer edge portion, and hinge means integrally joining said lever section to said central section, an imperforate side wall integral with and depending from said outer edge portion of said lever section, fulcrum means integral with and depending from said lever section annularly thereabout and spaced between said hinged means and said side wall for selective engagement with said container rim, said side wall having an inner surface with a concavity defined therein continuously about said side wall, said seal, when mounted to said container, receiving said rim edge within said concavity, said rim edge and said concavity being configured to define a hermetic sealing therebetween, said fulcrum means being positioned in closely spaced relation above said container rim radially inward of said rim edge and selectively engageable with said rim upon a depression of said top panel adjacent said hinge means for a resultant upward swinging of said side wall and a release of said container rim edge from said concavity, vent means defined transversely through said fulcrum means and maintaining air flow transversely through said fulcrum means upon engagement of s aid fulcrum means with said container rim, a convexity on said inner surface of said side wall coextensive with said concavity and immediately therebelow, said convexity including an upper surface extending into said concavity and a lower surface, said upper surface and said lower surface defining a central crown therebetween and second vent means defined along said lower surface for maintaining air flow about said rim edge as said seal is inwardly moved onto said container for a seating of said rim edge in said concavity.

14. The seal and container combination of claim 13 wherein said lower surface portion of said convexity is planar with protuberances projecting therefrom at spaced points about said seal, said second vent means being defined between adjacent protuberances.

15. The seal and container combination of claim 14 wherein said side wall includes a skirt portion below said convexity, said skirt portion including an inner face defined by said side wall inner surface, said skirt inner face being recessed relative to said concavity and receivable about said rim edge for alignment of said seal on said container rim without sealing engagement thereto.

16. The seal and container combination of claim 15 wherein said protuberances extend from said skirt inner face to said convexity crown.

17. A seal adapted to mount to an outwardly directed rim portion of a container, the rim portion having a peripheral lip; said seal comprising a top panel including a central section, a lever section peripherally about and extending outwardly from said central section thereabout and terminating in an outer edge portion, and hinge means integrally joining said lever section to said central section for pivotal movement of said lever section relative to said central section, a side wall integral with and depending from said outer edge portion of said lever section, fulcrum means integral with and depending from said lever section in spaced relation between said hinge means and said side wall and relatively closer to said side wall, said fulcrum means being selectively engageable with the container rim portion for fulcrum movement of said lever section and an upward and outward movement of said side wall upon a depression of said top panel adjacent said hinge means, said side wall having an inner surface, a concavity defined in said inner surface continuously along said side wall and downwardly spaced from said lever section for a hermetic sealed positioning of the rim lip therein upon downward movement of said seal on the container rim portion, said concavity being defined in part by a convexity on said inner surface coextensive with said concavity and immediately therebelow, vent means through said convexity for maintaining air flow as said seal is moved to position the container rim lip into said concavity, said side wall including a skirt portion below said convexity, said skirt portion having an inner face defined by said inner surface of said side wall, said skirt inner face being outwardly offset relative to said concavity and defining a seal mouth area of a diametric size adapted to freely receive the container rim portion therein for alignment of said seal on the container without a sealing of said seal to the container and as a guide for sealing said seal to the container, said convexity including upper and lower surface portions defining a central crown therebetween, said vent means being defined along said lower surface portion and extending between said skirt inner face and said crown whereby a continuous venting is provided about the rim lip as the lip moves inward of said seal and until such time as the rim lip reaches and moves inwardly beyond said convexity crown.

18. The seal of claim 17, wherein said lower surface portion of said convexity has protuberances projecting therefrom at spaced points about said seal, said vent means being defined between adjacent protuberances.

19. The seal of claim 17 wherein said fulcrum means comprises a depending integral fulcrum rib, said fulcrum rib including a lower edge portion engageable with the container rim, and a series of spaced recesses in said lower edge portion defining vent means for maintaining an air flow communication transversely across said fulcrum means when said fulcrum means is selectively engaged with the container rim portion for fulcrum movement of said lever section.

* * * * *